US007513492B1

(12) United States Patent
Kuo

(10) Patent No.: US 7,513,492 B1
(45) Date of Patent: Apr. 7, 2009

(54) HAND HELD QUICK-CLAMPING DEVICE

(75) Inventor: Tzu-Chi Kuo, Keelung (TW)

(73) Assignee: Sheng Pu Promotion Co., Ltd., Taipei Hsien (TW)

( * ) Notice: Subject to any disclaimer, the term of this patent is extended or adjusted under 35 U.S.C. 154(b) by 0 days.

(21) Appl. No.: 12/051,848

(22) Filed: Mar. 20, 2008

(51) Int. Cl.
*B25B 5/16* (2006.01)

(52) U.S. Cl. ..... 269/6; 269/3

(58) Field of Classification Search ..... 269/6, 269/2, 95, 166–171.5
See application file for complete search history.

(56) References Cited

U.S. PATENT DOCUMENTS 6,568,667 B1 * 5/2003 Hall ..... 269/6
7,172,183 B1 * 2/2007 Yang ..... 269/6
2008/0088071 A1 * 4/2008 Zheng ..... 269/6
2008/0157450 A1 * 7/2008 Marusiak ..... 269/6
2008/0246203 A1 * 10/2008 Alexander ..... 269/6

* cited by examiner

*Primary Examiner*—Lee D Wilson
(74) *Attorney, Agent, or Firm*—Pai Patent & Trademark Law Firm; Chao-Chang David Pai

(57) ABSTRACT

A hand held quick-clamping device includes an adjusting rod, a retaining handle, a driving handle, a first clamping block, and a second clamping block. The adjusting rod intersects the retaining handle, a set of adjusting sheets, and the stop sheets. A first clamping block is locked in a predetermined end of an adjusting rod, and a second clamping block is formed on a top end of the retaining handle. A driving handle is pivoted to the retaining handle. A traveling top shaft is installed in the retaining handle, and an axial shaft is opposite to it. While the driving handle is pressed, a top end of the driving handle pushes the top shaft. Through the top shaft, the axial shaft pushes the adjusting sheets and the stop sheets. And the movement of the sheets will drive an adjusting rod to move in one direction, thus producing a clamping or extending function.

12 Claims, 6 Drawing Sheets

HAND HELD QUICK-CLAMPING DEVICE

BACKGROUND OF THE INVENTION (a) Field of the Invention

The present invention relates to clamping devices, and more particularly to a hand held quick-clamping device which can be used to clamp or extend a work object.

(b) Description of the Prior Art

A prior art quick-clamping device comprises a rod body, a fixed clamping block, a movable clamping block, a first and a second engaging units, a first and a second bounce units, a button, a driving handle. The prior art quick-clamping device requires a large force to drive and can not provide a stable clamping or extending function. This is because the shorter moment arm of the driving handle takes more force to drive, and the first and the second engaging units are perpendicularly inserted by the rod body, so the positioning effect is not good and the clamping or extending force is not satisfied.

SUMMARY OF THE INVENTION

Accordingly, the primary object of the present invention is to provide a hand held quick-clamping device that does not have these drawbacks. The hand held clamping device of the present invention comprises: an adjusting rod, a retaining handle, a driving handle, a first clamping block, and a second clamping block. The first clamping block is disposed at one end of the adjusting rod and the second clamping block is disposed at the retaining handle. The retaining handle is pivoted to the driving handle. The retaining handle is installed with a moveable top shaft. At an opposite end of the top shaft there is an axial shaft. When the driving handle is operated, a top end of the driving handle will push the top shaft so that the axial shaft will press the adjusting sheets so that the two clamping blocks will perform the operation of clamping or extending. Since the driving handle pushes the top shaft by the top end so that the whole operation will be easier for the user.

The adjusting rod penetrates through the retaining handle, a set of adjusting sheets and a set of stop sheets which may be a single sheet or a plurality of sheets and are arranged adjacent to one another. Normally, the sheets are inclined to the adjusting rod so that when the two clamping blocks will generate greater clamping forces or extending forces.

Furthermore, the hand held quick-clamping device has a strip like lock sheet or a steel rope that penetrates through the adjusting sheets or stop sheets. Moreover, a releasing buckle will drive the stop sheets for releasing the adjusting rod and stop sheets from a force applied thereto.

DETAILED DESCRIPTION OF THE PREFERRED EMBODIMENTS

In order that those skilled in the art can further understand the present invention, a detailed description is provided in the following. However, the following description and the appended drawings are only used to enable those skilled in the art to understand the objects, features, and characteristics of the present invention, but are not intended to confine the scope and spirit of the present invention defined in the appended claims.

Figure 1:
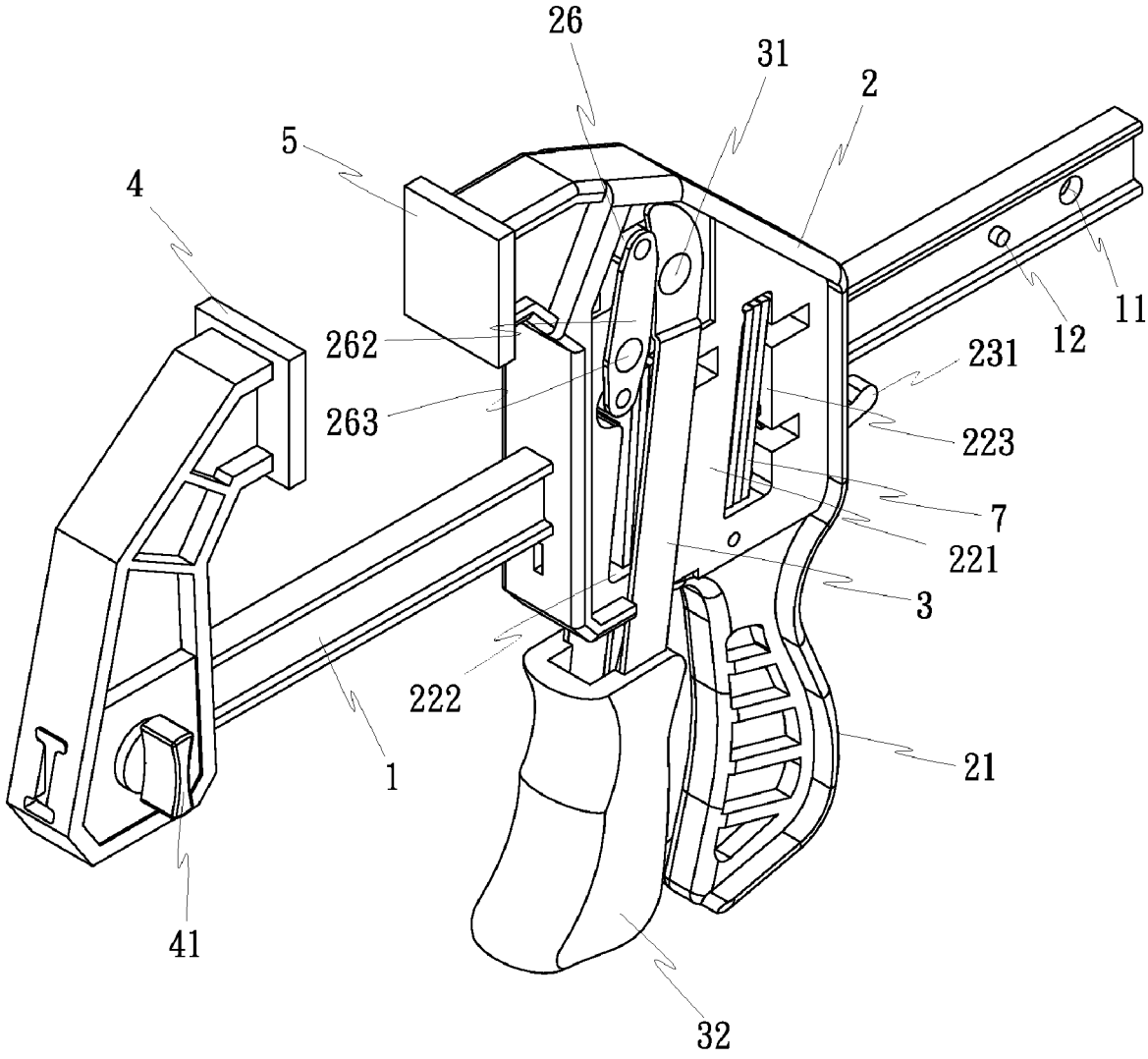
FIG. 1 shows an assembly view of a hand held quick-clamping device according to the present invention.

The hand held quick-clamping device of the present invention will be described below with reference to FIG. 1 to FIG. 3. The clamping device of the present invention includes an adjusting rod 1, a retaining handle 2, a driving handle 3, a first clamping block 4, and a second clamping block 5. The adjusting rod 1 intersects the retaining handle 2, a set of adjusting sheets 6, and a set of stop sheets 7. The adjusting rod 1 is a long rod, and it can be an H-shaped rod or a different type of rod. On both ends of the rod, there is a lock hole 11 and a bulgy stop block 12 which can be connected and locked by a first clamping block 4.

At a lower side of the retaining handle 2 is a hand held portion 21, and there is a front receiving chamber 222 and a rear receiving chamber 223 divided by a spacing rib 221 in an upper side of the retaining handle 2. The second clamping block 5 is installed on a top end of the retaining handle 2. A through hole 211 which communicates to the rear receiving chamber 223 is opened in the hand held portion 21, and a releasing buckle 23 is installed therein. The front receiving chamber 222 contains a set of adjusting sheets 6. The rear receiving chamber 223 contains the stop sheets 7. A groove 24 is provided through the spacing rib 221, the front receiving chamber 222, and the rear receiving chamber 223 to allow the adjusting rod 1 to pass through. A traveling top shaft 26 is installed in the retaining handle 2, and on the opposite side to the top shaft 26 is a pushing axial shaft 261 which is attached to the set of adjusting sheets 6. The top shaft 26 and the axial shaft 261 are linked by two lateral sheets 262 and a pivotal shaft 263.

The driving handle 3 has a pivotal shaft 31 at a top end thereof. The driving handle 3 is pivoted to the retaining handle 2. A top of the driving handle 3 is capable of resisting against the top shaft 26 of the retaining handle 2. A cover 32 may be enclosed around the driving handle 3.

Figure 4:
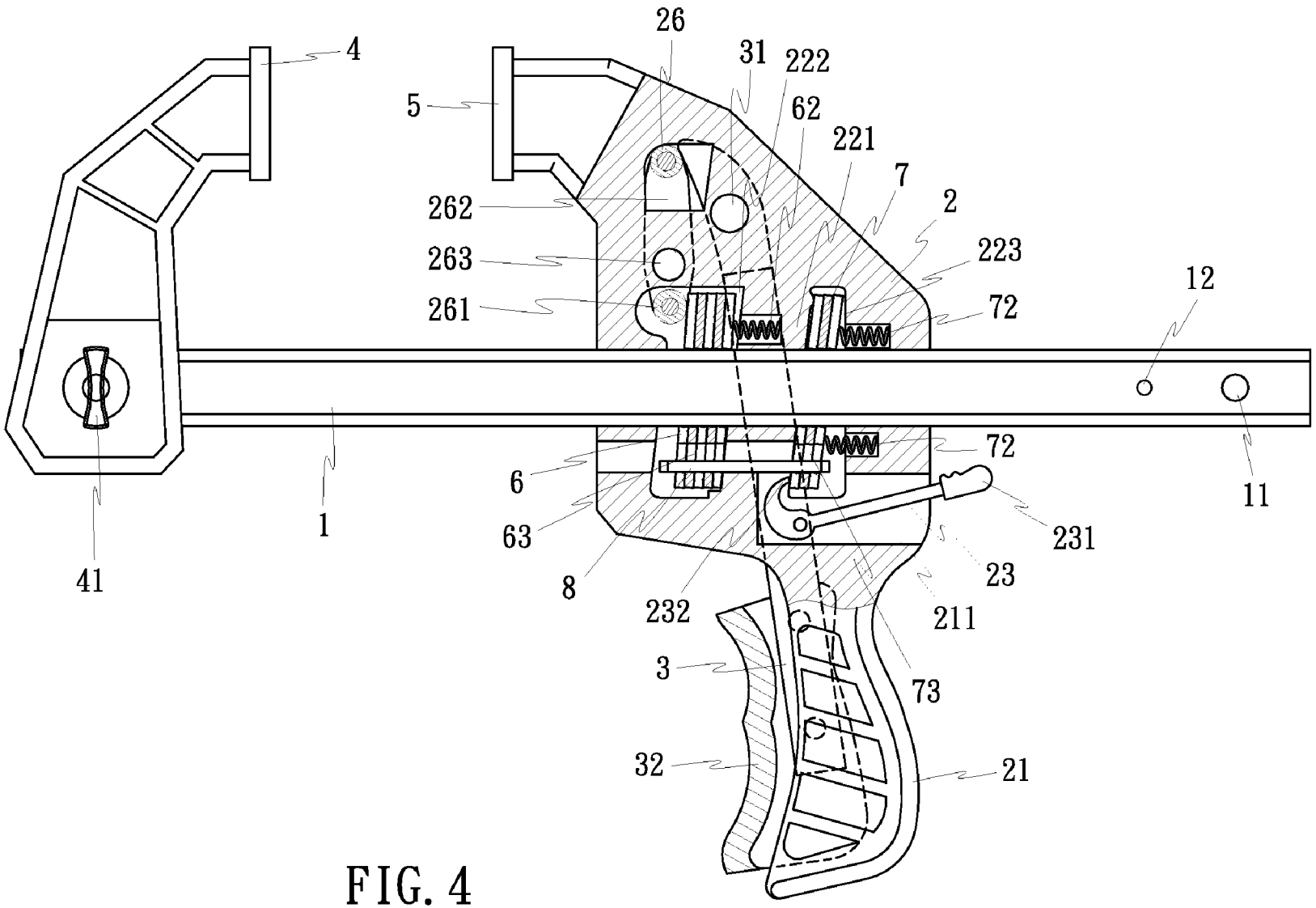
FIG. 4 shows the operation of the clamping device when the driving handle is pressed according to the present invention.
Figure 5:
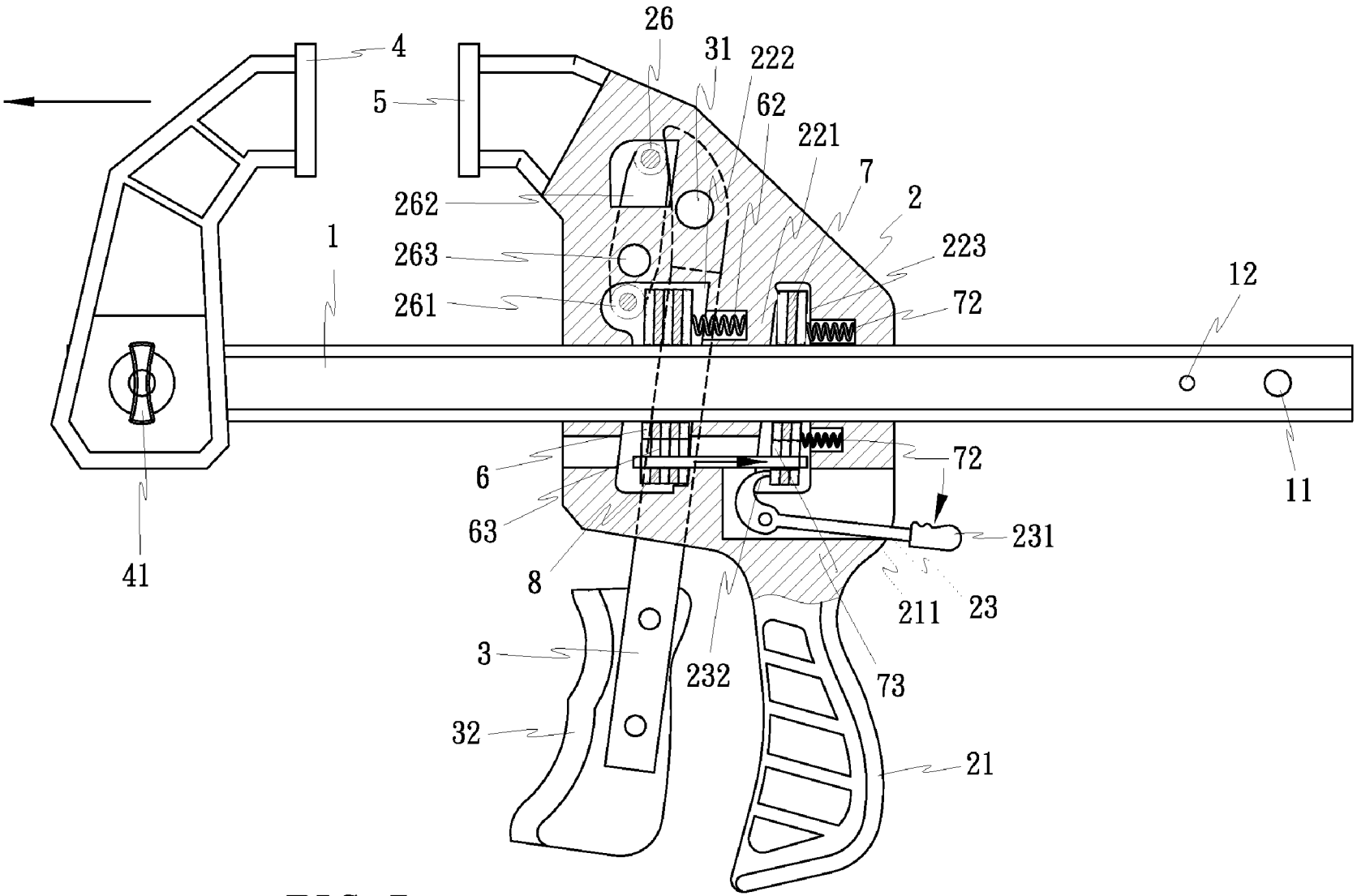
FIG. 5 shows the operation of the clamping device when the releasing buckle is pressed to release the adjusting rod from the stop sheets according to the present invention.
Figure 6:
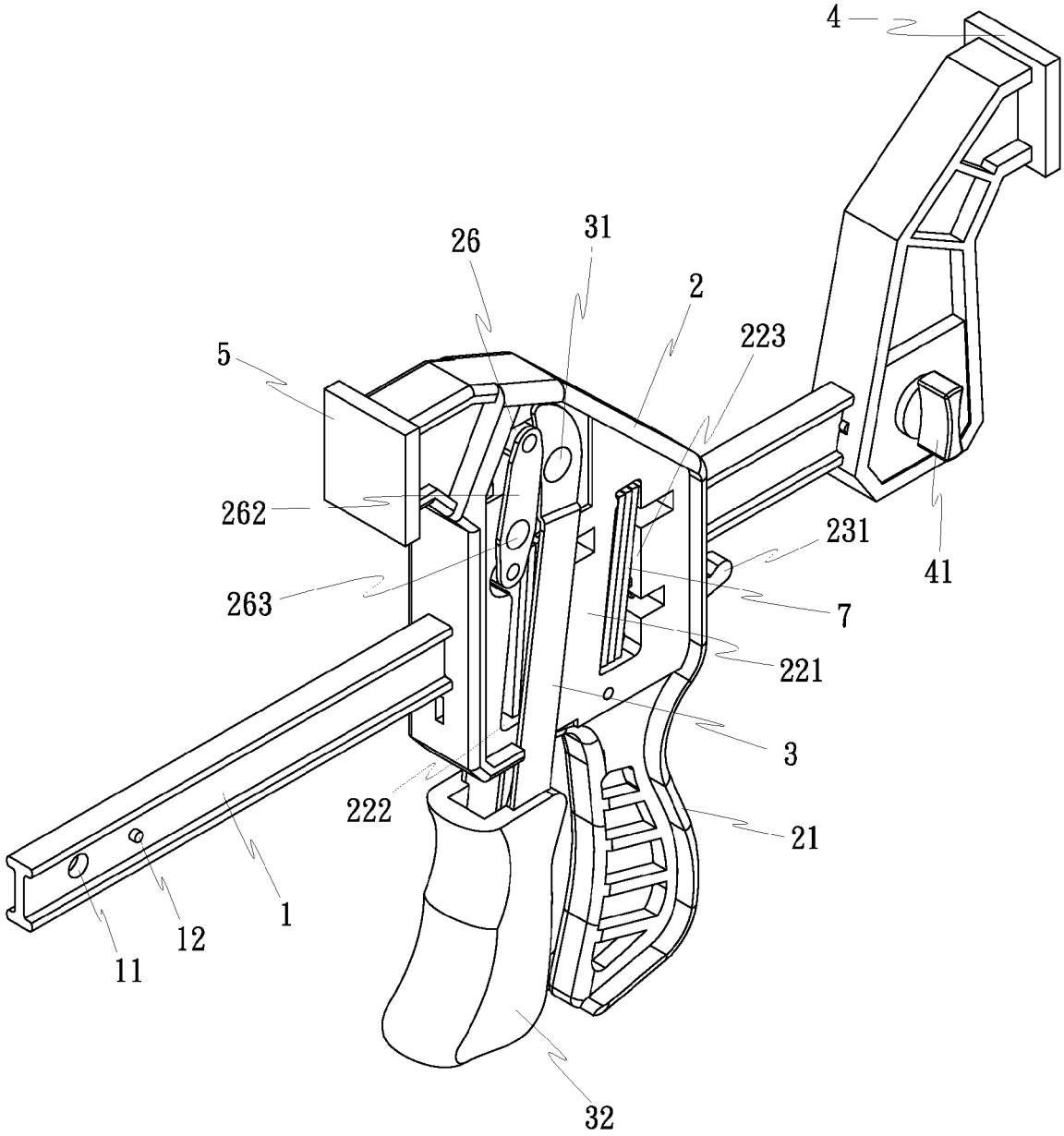
FIG. 6 shows the extending function with a first clamping block 4 installed on the rear end of the clamping device according to the present invention.

The first clamping block 4 is engaged to either predetermined end of the adjusting rod 1 by a stud 41 passing through a lock hole 11 in the adjusting rod 1. As illustrated in FIGS. 3 to 5, for providing a clamping function, the first clamping block 4 locks an object from the front end of the clamping device of the present invention. However in FIG. 6, for providing an extending function, the first clamping block 4 locks an object from a rear side of the device.

The second clamping block 5 is integrally formed or fixedly attached to an upper side of the retaining handle 2 and it is positioned at a position corresponding to that of the first clamping block 4.

Figure 2:
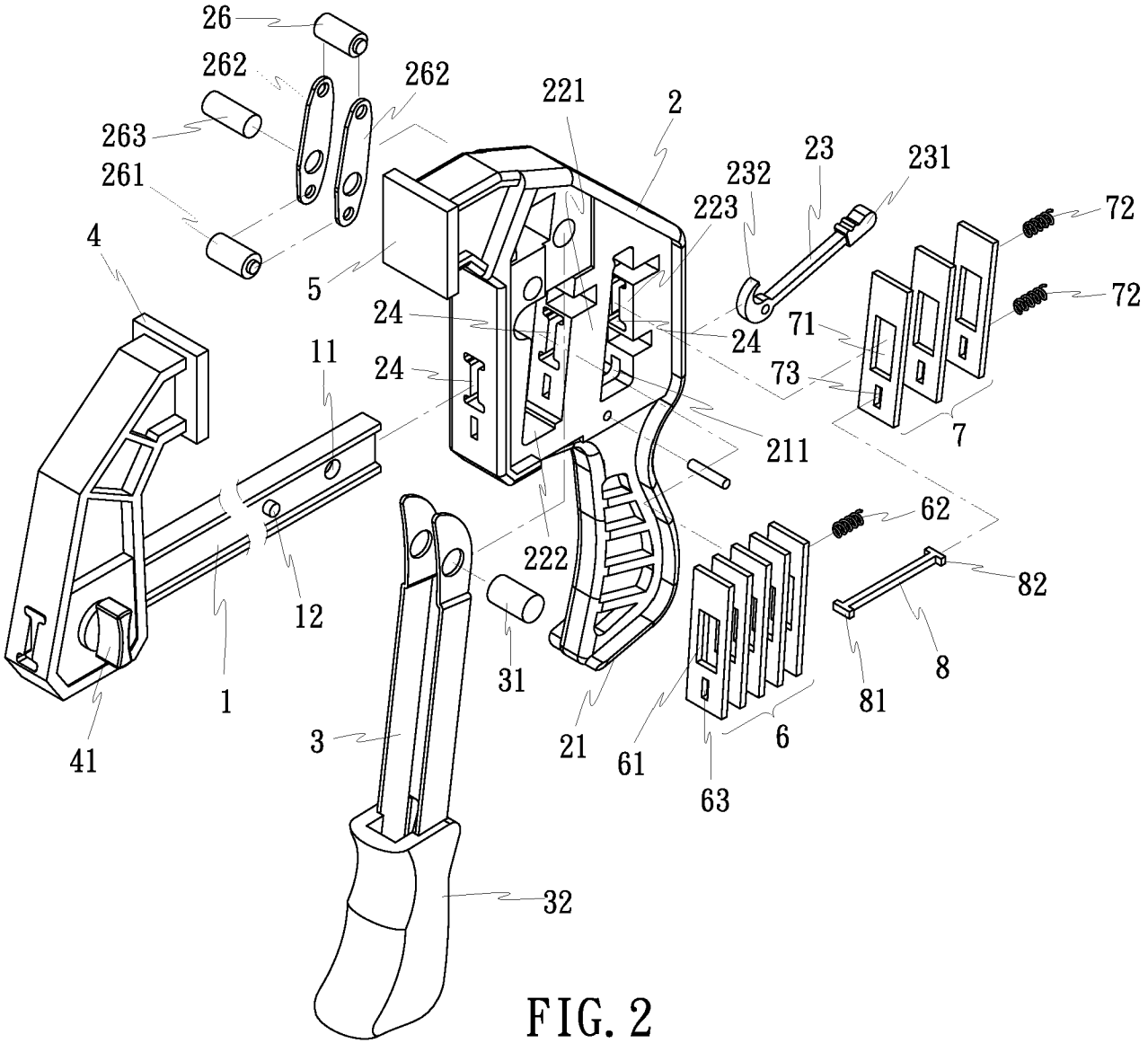
FIG. 2 shows the exploded perspective view of the hand held quick-clamping device shown in FIG. 1.
Figure 3:
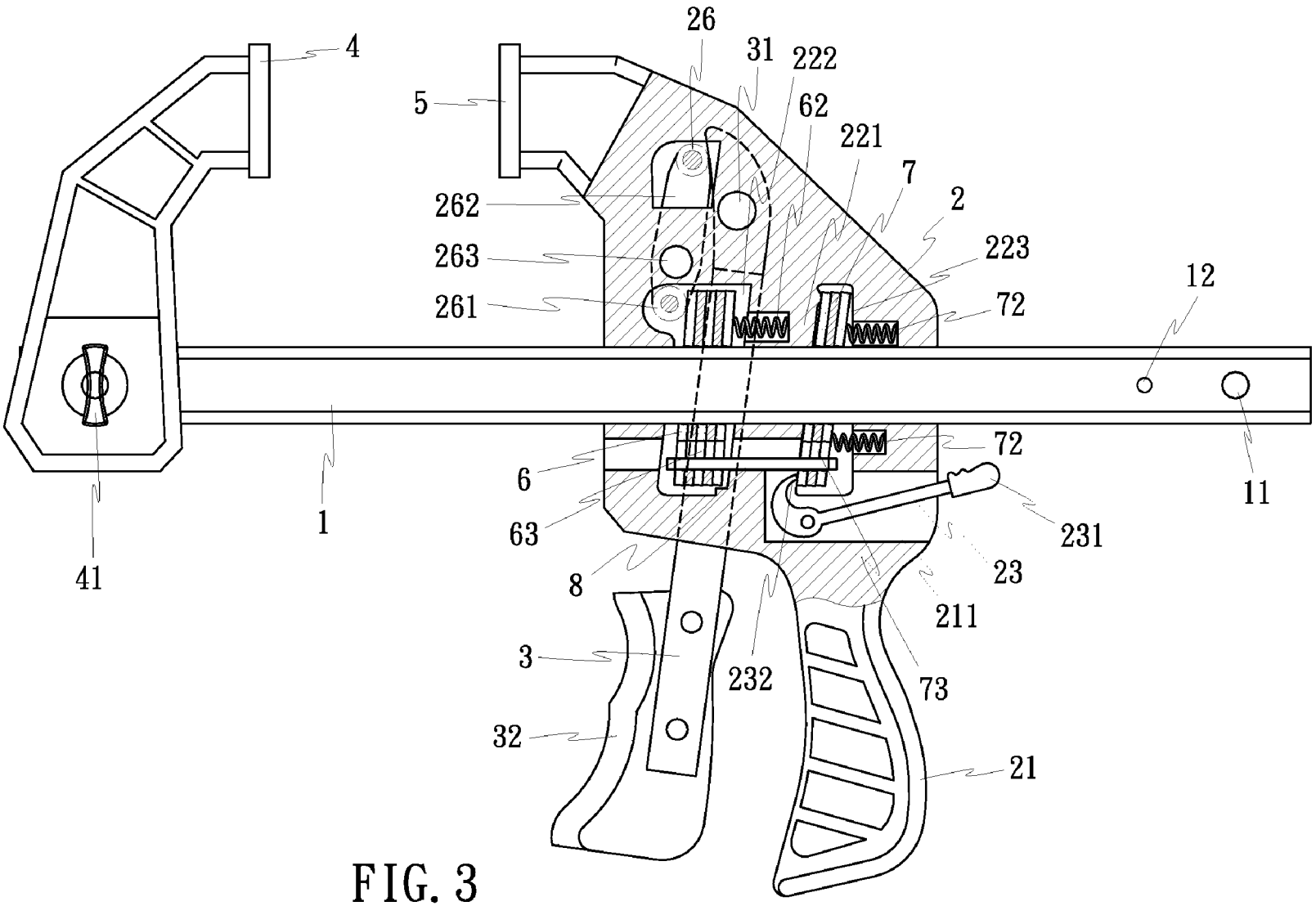
FIG. 3 is an assembled cross-sectional view of the clamping device shown in FIG. 1.

Referring to FIGS. 2 and 3, each of the adjusting sheets 6 is formed with a slot 61 and each of the stop sheets 7 is formed with a slot 71. The adjusting sheets 6 are received in the front receiving chamber 222 of the retaining handle 2 and the stop sheets 7 are received in the rear receiving chamber 223 of the retaining handle 2. The set of the adjusting sheets 6 is installed with a spring 62 and the set of the stop sheets 7 is installed with springs 72. The adjusting sheets 6 are arranged with one adjacent to another and the stop sheets 7 are arranged with one adjacent to another. In normal state, the adjusting sheets 6 and the stop sheets 7 are disposed so that they are inclined to the adjusting rod 1. When the driving handle 3 is pressed, the movement of the adjusting sheets 6 will drive the adjusting rod 1 to move in one direction, while the stop sheets 7 provide the function of stopping. A lock strip 8 passes through the adjusting sheets 6 and the stop sheets 7 so as to combine the two sheets together.

By the components mentioned above, when a driving handle 3 is pressed, the top shaft 26 is pushed by a top end of a driving handle 3. Then an axial shaft 261 opposite to the top shaft 26 will press an upper part of the set of adjusting sheets 6. The movement of the adjusting sheets 6 will drive the adjusting rod 1 to move in one direction, and thus the two clamping block 4 and 5 can perform a clamping or extending function. A top shaft 26 is pushed by a top end of a driving handle 3, thus the operation is easy to perform because of the long moment arm of the driving handle 3. FIG. 5 illustrates how the stopping function of the stop sheets 7 is disabled: pulling down the releasing buckle 23 releases the stop sheets 7 from an inclining angle to the adjusting rod 1. Thus the adjusting rod 1 is movable and can be repositioned relative to the retaining handle 2.

The adjusting sheets 6 are arranged with one adjacent to another and the stop sheets 7 are arranged with one adjacent to another, but depending upon the needs, the set of adjusting sheets 6 and the set of stop sheets 7 may each includes only a single sheet. The set of the adjusting sheets 6 is installed with a spring 62 on an upper side thereof, while the stop sheets 7 is installed with springs 72 on both upper and lower sides thereof. The stop sheets 7 are slightly more inclined to the adjusting rod 1 than are the adjusting sheets 6. In other words, the adjusting sheets 6 are more perpendicular to the adjusting rod 1 than the stop sheets 7. The stop sheets 7 always clutch the adjusting rod 1 no matter the driving handle 3 is pressed or not. When the driving handle 3 is pressed, it can suddenly lower the clutch force and cause a tiny movement of the stop sheets 7. While the driving handle 3 is released or stopped, the stop sheets 7 can provide a strong stopping function again. The adjusting sheets 6 are pressed by the axial shaft 261 opposite to the top shaft 26, and the movement of the adjusting sheets 6 will drive the adjusting rod 1 to move in one direction. While the driving handle 3 is released or stopped, the adjusting sheets 6 also incline to the adjusting rod 1 and work to stop the adjusting rod 1. As described above, the stopping function caused by the adjusting sheets 6 and the stop sheets 7 is extremely strong and it could provide a strong and stable clamping or extending force through the clamping blocks 4 and 5. The outstanding performance has been tested by the patent applicant that both of the clamping and extending forces are higher than 550 pounds.

The stopping function of the stop sheets 7 can be released by a releasing buckle 23. The releasing buckle 23 can correct the inclination between the stop sheets 7 and the adjusting rod 1 and then releases the stopping force. As illustrated, the releasing buckle 23 is pivoted on the hand held portion 21. The part of the releasing buckle 23 protrudes from the hand held portion 21 is a pressing portion 231 and a barb 232 is formed inside the hand held portion 21. When the releasing buckle 23 is pressed, the barb 232 pushes the stop sheets 7 and the stop sheets 7 will become more perpendicular to the adjusting rod 1. Meanwhile, through the link of the lock strip 8, the adjusting sheets 6 are also perpendicular to the adjusting rod 1. Thus it can release both of the adjusting sheets 6 and stop sheets 7 from stopping the adjusting rod 1 and then the adjusting rod 1 is no longer clutched and becomes movable.

For the purpose of driving the sheets as mentioned above, the operation and the configuration of the adjusting sheets 6, the stop sheets 7, and the lock strip 8 are obviously not the only solution to achieve that. For example, a releasing buckle 23 can directly push the lock strip 8. Furthermore, the actualization of the lock strip 8 and the releasing buckle 23 can be changed properly. For example, an equivalent steel rope can be used instead of the lock strip 8, and no specific shape is required of the releasing buckle 23. Such simple equivalent applications are described above and will not be enumerated in detail.

Every single sheet of the adjusting sheets 6 is formed with a through hole 63 and every single sheet of the stop sheets 7 is formed with a through hole 73. The lock strip 8 passes through the through holes 63 of the adjusting sheets 6 and the through holes 73 of the stop sheets 7, respectively. One end of the lock strip 8 is formed with a block 81 and another end thereof is formed with a block 82, as illustrated in FIG. 2. The block 81 is interactive with the block 82 between the adjusting sheets 6 and the stop sheets 7. Referring to FIGS. 3 and 4, a length of the lock strip 8 is properly longer than a total width of the adjusting sheets 6 and the stop sheets 7 when they are in the assembled state. And at a certain installation angle, the lock strip 8 can go through the adjusting sheets 6 and the stop sheets 7 without being blocked and then it is turned 90 degrees so as to hold the sheets 6 and 7 from slipping out of the blocks 81 and 82.

The illustrations mentioned above are the preferred embodiments of the present invention. All the equivalent applications or any simple modifications which are based on the former technique should be regarded as within the scope of the present patent.

What is claimed is:

1. A hand held quick-clamping device, comprising an adjusting rod 1, a retaining handle 2, a driving handle 3, a first clamping block 4, and a second clamping block 5; the adjusting rod 1 penetrating through the retaining handle 2, and a set of adjusting sheets 6, wherein the adjusting rod is a long rod for locking the first clamping block at one end thereof;

the retaining handle has a holding portion at a lower end thereof and an upper end of the retaining handle is formed by a front receiving chamber and a rear receiving chamber which are spaced by an isolating rib section; an upper side of the retaining handle is installed with the second clamping block;

a through hole communicated to the rear receiving chamber is formed in the hold portion and is pivoted with a release buckle;

the rib section, the front receiving chamber and the rear receiving chamber are formed with respective holes for the movement of the adjusting rod and for receiving a set of adjusting sheets and a set of stop sheets; the retaining handle is installed with one end of a movable top shaft; and another end of the top sheet is installed with an axial shaft which ejects to the adjusting sheets;

a top end of the driving handle is installed with a pivoted shaft so that the driving handle is pivoted to the retaining handle;

and a top portion of a body of the driving handle resists against a top of the retaining handle;

the second clamping block is engaged to and locked to any predetermined end of the adjusting rod;

the second clamping block is firmly secured to be in front of the retaining handle and is positioned corresponding to the first clamping block;

each sheet in the set of the adjusting sheets and the set of stop sheets has a respective slot for receiving the retaining handle to be placed in the front receiving chamber and the rear receiving chamber; each sheet of the adjusting sheets and stop sheets has a respective spring;

wherein by above mentioned elements, when the driving handle is pressed and thus is actuated, the top portion of the driving handle will push the top shaft and the axial shaft of the driving handle will press the adjusting sheets at a front end thereof; thus by displacement of the adjusting sheets, the adjusting rod will be driven to move in one direction; thus the first and second clamping block will have the function of clamping and extending; further, by the releasing buckle to buckle the stop sheets, the angle of the sheets are calibrated so as to release the buckling action between the adjusting rod and the adjusting sheets; thereby, respective positions between the adjusting rod and the retaining handle is adjustable.

2. The hand held quick-clamping device as claimed in claim 1, wherein the top shaft movable installed to the retaining handle and the axial shaft are connected by two lateral sheets and a pivotal shaft.

3. The hand held quick-clamping device as claimed in claim 1, wherein the second clamping block is integrally formed or fixedly combined to an upper side of the retaining handle.

4. The hand held quick-clamping device as claimed in claim 1, wherein sizes of the slots of the adjusting sheets and stop sheets are identical to or slightly larger than a size of a rod body of the adjusting rod.

5. The hand held quick-clamping device as claimed in claim 1, wherein there are plurality of adjusting sheets which are arranged with one adjacent to another; and there are a plurality of stop sheets which are arranged with one adjacent to another.

6. The hand held quick-clamping device as claimed in claim 1, wherein each adjusting sheet and each stop sheet is inclinedly installed to the adjusting rod.

7. The hand held quick-clamping device as claimed in claim 1, wherein only an upper end of each adjusting sheet is installed with an ejecting spring and each of an upper end and a lower end of each stop sheet has an ejecting spring.

8. The hand held quick-clamping device as claimed in claim 1, wherein an outer side of the releasing buckle has a buckling portion and an interior thereof has a hook portion which can push the stop sheet to calibrate the angle.

9. The hand held quick-clamping device as claimed in claim 1, wherein a strip of locking sheet penetrates through each adjusting sheet and each stop sheet.

10. The hand held quick-clamping device as claimed in claim 9, wherein each adjusting sheet and each stop sheet has a penetrating hole which is passed through by the stripe like locking sheet; each of a front end and a rear end of the locking sheet has a protruding isolating portion.

11. The hand held quick-clamping device as claimed in claim 10, wherein a length of the locking sheet is larger than the total length of the plurality of adjusting sheets and the plurality of stop sheets.

12. The hand held quick-clamping device as claimed in claim 10, wherein each of two ends of the adjusting rod is provided with a lock hole and protruded stop block.

* * * * *